United States Patent [19]

Page et al.

[11] 4,309,228

[45] Jan. 5, 1982

[54] ELECTRO MAGNETIC STEELS

[75] Inventors: James H. R. Page, Machen; Alan Coombs, Newport, both of Wales

[73] Assignee: British Steel Corporation, London, England

[21] Appl. No.: 133,571

[22] Filed: Mar. 24, 1980

[51] Int. Cl.[3] ..... H01F 1/00

[52] U.S. Cl. ..... 148/120; 148/12 A; 148/12 F

[58] Field of Search ..... 148/120, 121, 12 A, 148/12 F; 75/123 D, 123 M

[56] References Cited

U.S. PATENT DOCUMENTS

| | | | |
|---|---|---|---|
| 3,819,426 | 6/1974 | Decaro et al. | 148/120 |
| 3,923,560 | 12/1975 | Regitz | 148/121 |
| 4,082,576 | 4/1978 | Lake et al. | 148/12 F |
| 4,105,474 | 8/1978 | Nakasugi et al. | 148/12 F |
| 4,141,761 | 2/1979 | Abraham et al. | 75/123 M |
| 4,170,468 | 10/1979 | Regitz | 148/120 |

*Primary Examiner*—L. Dewayne Rutledge
*Assistant Examiner*—John P. Sheehan
*Attorney, Agent, or Firm*—Bacon & Thomas

[57] ABSTRACT

A method for producing a non-silicon steel for electro magnetic applications includes the steps of producing a vacuum de-gassed steel melt containing less than 0.025% by weight of carbon, between 0.1% and 1.0% of manganese, between 0.01% and 0.15% phosphorus, not more than 0.02% of sulphur, not more than 0.007% of nitrogen, with titanium within the range of 0.05% to 0.25%, the reminder being iron, except for incidental impurities, hot rolling slab derived from the melt, using a finishing temperature within the range 900° C. to 950° C. and coiling the resulting hot rolled strip at a temperature of not less than 700° C.

15 Claims, No Drawings

ELECTRO MAGNETIC STEELS

This invention relates to the production of steel for electro magnetic applications and is particularly concerned with such steels having no added silicon. The invention is specifically directed to non-silicon isotropic electrical steels displaying a relatively low variation of power loss with time and such steels are hereinafter referred to as magnetic ageing resistant steels.

The production of steel sheet or strip for electro magnetic applications involves a number of process steps which determine the final required magnetic and mechanical characteristics. One magnetic parameter of importance which must be controlled within specified limits is the total power loss which occurs in the strip when this is excited by an alternating magnetic field. Since power loss is an accepted criterion of quality, its value after production of the steel strip as well as its variation with time become significant.

Additionally an important mechanical criteria is the level of hardness achieved in the final product. This has to be controlled by a suitable choice of material chemistry and processing to achieve a level and a consistency which will ensure good stamping or punching properties.

The non-silicon steel to which this invention refers may be supplied as fully annealed material or semi-processed material, the latter generally being referred to as semi-hard or not fully annealed (N.F.A.) material. By the term fully annealed material is meant that the steel supplier produces material in which the magnetic properties are fully developed by a process of one or more cold rollings and which the final process is an anneal.

By the term semi-processed material is meant that the final annealing is carried out at the Customer's Works after firstly punching the strip into laminations. By either process is produced material which when finally annealed either by supplier or Customer has a total power loss typically in the range 7–10 Watts per kg., at an induction of 1.5 Tesla at a frequency of 50 Hz, depending upon composition, processing conditions and final thickness.

Unless particular attention is paid to the processing of the material a deterioration in the magnetic properties of this material can occur after processing has been completed. This deterioration of magnetic properties with time is termed magnetic ageing and is usually expressed as a percentage increase in total power loss (Watts/kg) at a specified induction (e.g. 1.5 Tesla 50 Hz). Minimisation of this deterioration requires customers of semi-processed products to invest in expensive temperature and atmosphere control systems to provide an effective decarburising atmosphere in their annealing furnaces to achieve minimum power loss levels and magnetic stability by reduction of carbon to less than about 0.005%. This in turn places constraints upon the manufacturing works to produce a material which will behave consistently under customer annealing conditions. In fully annealed grades similar attention to final annealing has to be paid by the manufacturer especially in the case of final annealing in a continuous furnace with the concomitant rapid cooling. It is accordingly the object of the present invention to produce a steel for electromagnetic applications having improved ageing characteristics such that the above constraints on the manufacturing processes may be removed.

According to one aspect of the present invention, a method for producing a non-silicon steel for electro magnetic applications includes the steps of producing a vacuum de-gassed steel melt containing less than 0.025% by weight of carbon, between 0.1% and 1.0% of manganese, between 0.01% and 0.15% phosphorus, not more than 0.02% of sulphur, not more than 0.007% of nitrogen, with titanium within the range of 0.05% to 0.25%, the remainder being iron, except for incidental impurities, hot rolling slab derived from the melt, using a finishing temperature within the range 900° C. to 950° C. and coiling the resulting hot rolled strip at a temperature of not less than 700° C.

In a preferred embodiment of the invention, the phosphorus concentration of the melt is adjusted to be within the range 0.05% to 0.15%. In addition, aluminium also may be added to the melt, suitably in a concentration of not more than 0.05%, in order to combine with any residual free oxygen present after the vacuum decarburising stage of the vacuum degassing treatment, and prior to the addition of titanium.

In the case of fully annealed strip the hot rolled strip after conventional cooling subsequent to coiling and followed by pickling is cold rolled to substantially final gauge by single stage reduction, or by two stage reduction with an intermediate anneal. In the single stage route the hot band is directly cold reduced to substantially final gauge in conventional manner and is subsequently strand annealed at a temperature conveniently within the range 950° C. to 1000° C. It is an aspect of this invention that the process of decarburisation is unnecessary and this anneal may thus be carried out in a non-decarburising atmosphere, unlike conventional processing in which annealing in a decarburising atmosphere is mandatory.

An alternative method of producing fully annealed material is by a two stage cold reduction. Here hot rolled strip after conventional cooling subsequent to coiling and followed by pickling, is cold rolled to 10% to 15% above final gauge and is subsequently strand annealed at a temperature typically in the range 900° C.–950° C. The anneal intermediate between the two stages of cold reduction may be carried out in a non-decarburising atmosphere as is the case of the fully annealed material produced by a single cold reduction. After the intermediate anneal the strip is cold rolled to substantially final gauge in the second reduction step. This second reduction is then followed by an anneal in a continuous furnace typically in the temperature range 900° C.–950° C. in an atmosphere which may be non-decarburising.

In the case of semi processed strip where two stage cold reduction is employed, the hot rolled strip after conventional cooling subsequent to coiling and followed by pickling is cold rolled to 10% to 15% above final gauge and is subsequently strand annealed at a temperature within the range 900° C. to 950° C.

The anneal intermediate between the two stages of cold reduction may be carried out in a non-decarburising atmosphere, as in the case of the fully annealed material. After the intermediate anneal, the strip is cold rolled to substantially final gauge in the second reduction step.

In the above, whilst annealing has been referred to as being carried out in a continuous furnace this is in no way meant to be limiting, such anneals may also be carried out in non-continuous or batch furnaces.

Embodiments of the invention will now be described in the following examples directed to the production of non-silicon isotropic steel strip for electro magnetic applications.

EXAMPLE 1

Steel derived from any conventional refining process such as basic oxygen or open hearth refining is vacuum de-gassed to reduce the level of carbon and oxygen and is innoculated to produce a final composition of 0.019% carbon, 0.095% titanium, 0.085% phosphorous, 0.64% manganese with nitrogen at 0.005%, the remainder being iron except for incidental impurities. The manganese, phosphorus and titanium are added after vacuum decarburisation and removal of any residual oxygen by addition of aluminium. Hot metal, after vacuum degassing is, again in conventional manner, cast into ingots which are slabbed for subsequent hot rolling.

Slab produced from the melt and having the composition according to the present invention is hot rolled with a finishing temperature of about 925° C. to a nominal thickness of 2.0 mm and is subsequently coiled so that its temperature on coiling lies above 700° C. After relatively slow cooling, which is inherent of strip in tightly wound coil form after conventional coiling, the hot band is pickled and cold rolled to an intermediate thickness of 0.71 mm. This cold reduced material is interannealed in a conventional strand annealing furnace arranged to maintain a strip temperature of 900° C. After annealing, which is preferable in a non-decarburising atmosphere, but which may be undertaken in a decarburising atmosphere, the strip is given a second 10% cold reduction to the final thickness of 0.65 mm. The level of this final cold reduction is critical in ensuring that a large grain size, necessary to produce acceptable magnetic properties as (for example, defined by the total power loss expressed in Watts per kg at an induction of 1.5 Tesla and at a test frequency of 50 Hz) results after the final anneal carried out by the customer.

The semi-hard material produced in this manner must now be given an anneal by the customer either in a non-decarburising or decarburising atmosphere for one hour at a temperature at or above 800° C. Further whilst it is conventional practice to perform this anneal in a decarburising atmosphere the length of such an anneal depends principally upon the precise level of ingoing carbon in the laminations, and the precise point of completion of decarburisation is difficult to determine. Since it is a requirement of any economic manufacturing process such as annealing, that it be carried out under constant conditions there is the possibility that decarburisation may be incomplete. To overcome this it is necessary that the rate of cooling be controlled to ensure that carbon and nitrogen are not held in solid solution to be precipitated over a lengthy period when the material is in service in an electro-magnetic machine. Typically this rate of cooling between 800° C. and 500° C. should not exceed 150° C. per hour. It is a feature of this invention that no such constrain need be put upon the rate of cooling from 800° C., and that cooling rates up to the point where the strip would be distorted by the rapidity of the cool may be tolerated.

Strip produced by the foregoing process was found to display low ageing of less than 0.1% over 14 days at 150° C.

The minimisation of ageing in steel produced by the present invention obviates the need for users of the steel who produce stamped components to decarburise anneal in conventional manner and results in considerable saving of cost.

EXAMPLE II

A steel was manufactured in B.O.S. vessel, vacuum degassed to a composition containing 0.015%C, 0.28%Mn, 0.06%P, 0.020%S, 0.006%$N_2$, and 0.15%Ti, balance iron or incidental impurities, cast into an ingot, hot rolled into slabs and subsequently further hot rolled to coil of 2.00 mm thickness, with a finishing temperature of 1650° F. (900° C.), and a coiling temperature of 1290° F. (700° C.). The hot rolled coil was pickled and subjected to a cold rolling of 67.5% reduction to a thickness of 0.65 mm. The cold rolled coil was then subjected to a continuous anneal at 950° C. for some 2.5 minutes. Magnetic ageing tests carried and at 150° C. for 14 days, in accordance with BS 601 indicated that, the material exhibited no measurable magnetic ageing.

EXAMPLE III

A steel was manufactured to the following composition 0.013%C, 0.26%Mn, 0.01%P, 0.02%S, 0.006%$N_2$, and 0.15%Ti, balance iron or incidental impurities was cast into an ingot, hot rolled into slabs and subsequently further hot rolled to coil of 2.00 mm thickness, with a finishing temperature of 1650° F. (900° C.), and a coiling temperature of 1290° F. (700° C.). The hot rolled coil was pickled and subjected to a cold rolling of 67.5% reduction to a thickness of 0.65 mm. The cold rolled coil was then subjected to a continuous anneal at 1000° C. for some 2.5 minutes. Magnetic ageing tests carried and at 150° C. for 14 days, in accordance with BS 601 indicated that, the material exhibited no measurable magnetic ageing.

We claim:

1. A method for producing a non-silicon steel for electro magnetic applications including the steps of producing a vacuum de-gassed steel melt containing less that 0.025% by weight of carbon, between 0.1% and 1.0% of manganese, between 0.01% and 0.15% phosphorus, not more than 0.02% of sulphur, not more than 0.007% of nitrogen, with titanium within the range of 0.05% to 0.25%, the remainder being iron, except for incidental impurities, hot rolling a slab derived from the melt to produce a strip using a finishing temperature within the range 900° C. to 950° C. and coiling the resulting hot rolled strip at a temperature of not less than 700° C., cold rolling the strip after coiling and cooling and annealing the cold rolled strip at a temperature within the range of about 900° C. to 1000° C.

2. A method, as claimed in claim 1, wherein the phosphorus concentration of the melt is adjusted to lie within the range 0.05% to 0.15%.

3. A method for producing a non-silicon steel for electro magnetic applications including the steps of producing a vacuum de-gassed steel melt containing less than 0.025% by weight of carbon, between 0.1% and 1.0% manganese, between 0.01% and 0.15% phosphorus, not more than 0.02% of sulphur, not more than 0.007% of nitrogen, with titanium within the range of 0.05% to 0.25%, the remainder being iron, except for incidental impurities, adding aluminum to the melt in a quantity effective to produce a concentration of not more than 0.05%, hot rolling a slab derived from the melt to produce a strip, using a finishing temperature within the range 900° C. to 950° C. and coiling the resulting hot rolled strip at a temperature of not less than 700° C., cold rolling the strip after coiling and cooling and annealing the cold rolled strip at a temperature within the range of about 900° C. to 1000° C.

4. A method for producing a non-silicon steel for electro magnetic applications including the steps of producing a vacuum de-gassed steel melt containing less than 0.025% by weight of carbon, between 0.1% and 1.0% of manganese, between 0.01% and 0.15% phosphorus, not more than 0.02% sulphur, not more than 0.007% of nitrogen, with titanium within the range of 0.05% to 0.25%, the remainder being iron, except for incidental impurities, adjusting the phosphorus concentration of the melt to lie within the range 0.05% to 0.15%, adding aluminum to the melt in a quantity effective to produce a concentration of not more than 0.05%, hot rolling a slab derived from the melt to produce a strip, using a finishing temperature within the range 900° C. to 950° C. and coiling the resulting hot rolled strip at a temperature of not less than 700° C., cold rolling the strip after coiling and cooling and annealing the cold rolled strip at a temperature within the range of about 900° C. to 1000° C.

5. A method, as claimed in any one of claims 1, 3, or 4, wherein the hot rolled strip is cold rolled to substantially final gauge by single stage reduction.

6. A method, as claimed in claim 5, wherein the cold reduced strip is annealed at a temperature within the range of 950° C. to 1000° C.

7. A method, as claimed in any one of claims 3 or 4, wherein the hot rolled strip is cold rolled to substantially final gauge by two stage reduction with an intermediate anneal.

8. A method, as claimed in claim 7, wherein the hot rolled strip is initially cold rolled to within 10% to 15% above final gauge.

9. A method, as claimed in claim 7, wherein the intermediate anneal is at a temperature within the range 900° C. to 950° C.

10. A method, as claimed in claim 9, wherein the intermediate anneal is in a non-decarburising atmosphere.

11. A method, as claimed in claim 7, wherein the cold rolled strip of final gauge is annealed at a temperature within the range 900° C. to 950° C.

12. A method, as claimed in claim 11, wherein the annealing is in a non-decarburising atmosphere.

13. A non-silicon steel for electro magnetic applications when produced by the method of any one of claims 1, 3, or 4.

14. A method as claimed in claim 8, wherein the intermediate anneal is at a temperature within the range 900° C. to 950° C.

15. A method, as defined in any one of claims 1, 3 or 4 wherein the vacuum de-gassed steel melt has a carbon content no higher than 0.019%.

* * * * *